United States Patent [19]

Piotrowski

[11] 4,057,025

[45] Nov. 8, 1977

[54] ANCHOR DAVIT

[75] Inventor: Eugene Gregory Piotrowski, Stevens Point, Wis.

[73] Assignee: The Worth Company, Stevens Point, Wis.

[21] Appl. No.: 708,890

[22] Filed: July 26, 1976

[51] Int. Cl.[2] ..... B63B 21/22

[52] U.S. Cl. ..... 114/210; 9/34

[58] Field of Search ..... 254/197; 114/210; 9/34–39

[56] References Cited

U.S. PATENT DOCUMENTS

| | | | |
|---|---|---|---|
| 1,640,672 | 8/1927 | Schauman | 114/210 |
| 3,025,821 | 3/1962 | Robinson | 114/210 |
| 3,261,319 | 7/1966 | Ellis | 114/210 |
| 3,906,882 | 9/1975 | Mayfield | 114/210 |
| 3,952,683 | 4/1976 | Eudy | 114/210 |

*Primary Examiner*—Trygve M. Blix
*Assistant Examiner*—D. W. Keen
*Attorney, Agent, or Firm*—Andrus, Sceales, Starke & Sawall

[57] ABSTRACT

An anchor davit for stowing an anchor generally horizontally when it is out of the water. A support roller extends between two frame portions, and an anchor receiving strap is mounted for movement about the said roller. An arm extends from inwardly of the said roller, where it is pivotally mounted to extend outwardly and above the open strap. A further roller is disposed on the outer end of the arm for receiving the anchor cable thereover. Both the strap and the arm are biased outwardly about their respective pivot axes.

8 Claims, 5 Drawing Figures

ANCHOR DAVIT

PRIOR ART OF INTEREST

U.S. Pat. No. 3,952,683, Eudy et al., Apr. 17, 1976.

BACKGROUND AND SUMMARY OF THE INVENTION

This invention relates to an anchor davit for small boats which is for use in stowing an anchor on the boat and releasing same when it is to be used.

In the device disclosed in the above-mentioned U.S. Pat. No. 3,952,683, the davit provides a support roller and a loop or strap for guiding the anchor line and for holding the anchor in place. The strap is freely movable between a lower stop and an upper stop and drops by gravity during release of the anchor. During raising of the anchor, the shank thereof engages the support roller and is pulled sharply around the axis thereof until the anchor head engages the strap and pivots it upwardly to stowing position.

The present invention is based on a number of improvements over the structure of the above mentioned patent.

In accordance with one aspect of the present invention, a separate biased control arm is provided, with the arm having a roller at its outer end over which the anchor cable is trained. When the anchor is in actual use or being raised, the arm roller is disposed generally above the central open portion of the strap, outwardly of the support roller. As the anchor is raised into the davit, the anchor cable follows a path substantially spaced from the support roller and the anchor shank initially engages the control arm end. The arm then is forced to pivot inwardly by the anchor shank tip. During this movement, the cable and anchor follow a curved path of substantially larger radius than in the prior patented device, thus reducing or eliminating any tendency of the anchor or its eye to jam or bind while making the turn. Also, the force required for making the turn is substantially reduced.

In accordance with another aspect of the invention, the strap is continuously biased outwardly and the biasing force must be overcome by the anchor as it is manipulated into the davit. When it is desired to release the anchor, the biasing action of both the arm and the strap combine to quickly thrust the anchor into a vertical position for dropping into the water.

The biased strap construction assures that the anchor will be under constant tension, regardless of sudden boat movement and/or slack occurring in the anchor cable.

BRIEF DESCRIPTION OF THE DRAWINGS

The accompanying drawings illustrate the best mode presently contemplated by the inventor for carrying out the invention.

In the drawings.

DESCRIPTION OF THE PREFERRED EMBODIMENT

Figure 1:
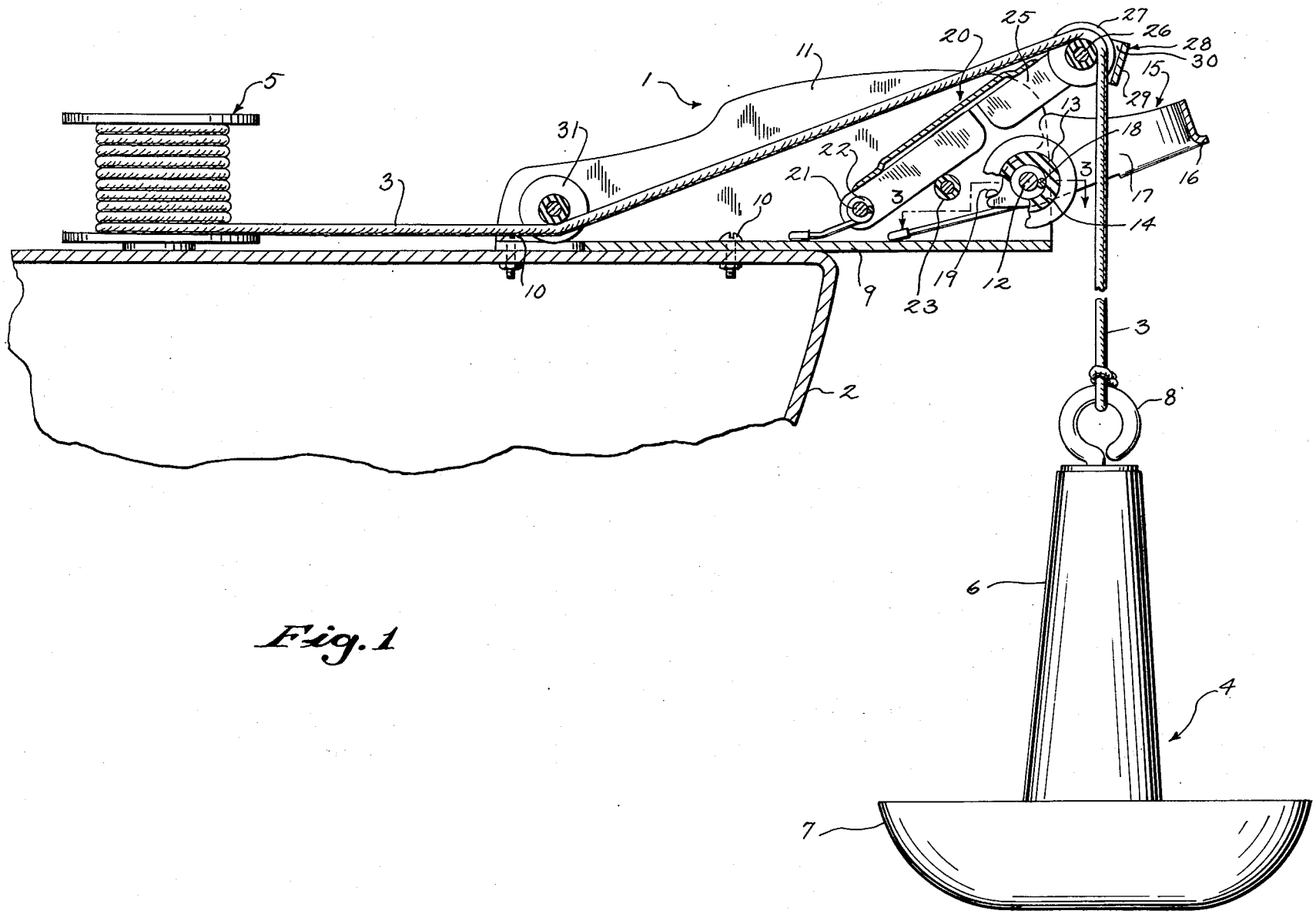
FIG. 1 is a generally vertical longitudinal section of an anchor davit constructed in accordance with the invention, taken on line 1—1 of FIG. 2, and showing an anchor hanging therefrom.
Figure 2:
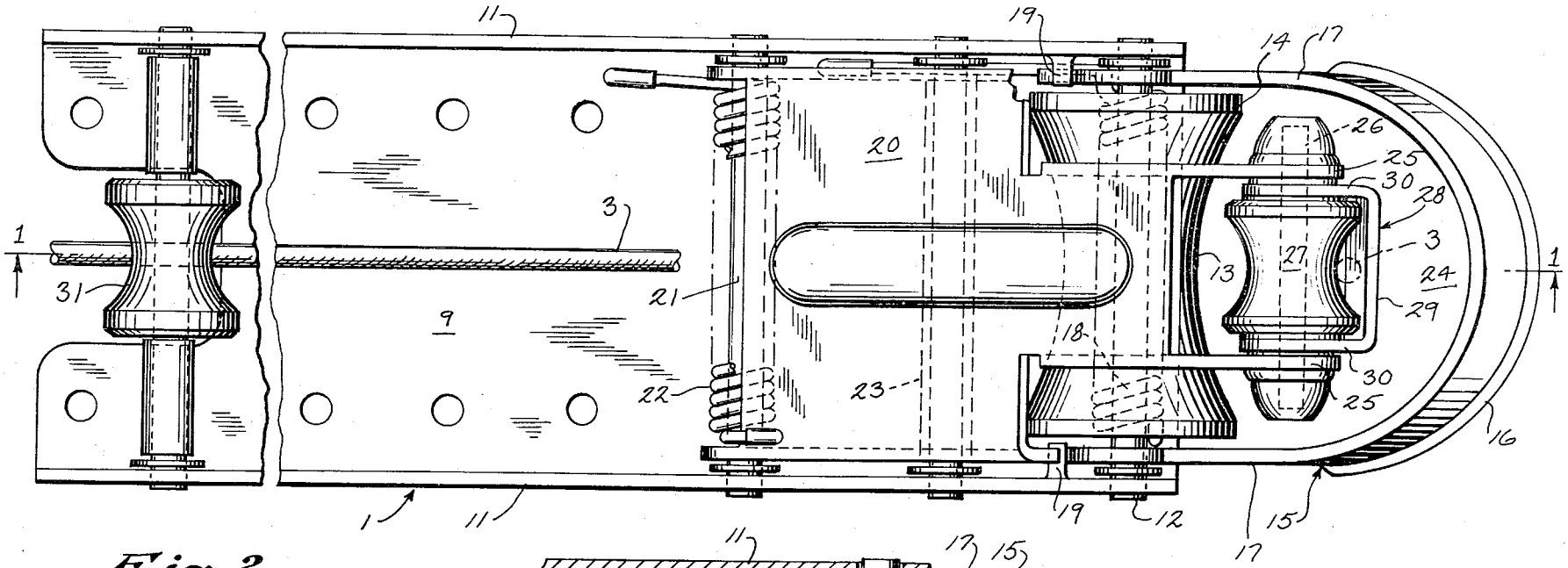
FIG. 2 is an enlarged top plan view of the davit of FIG. 1.

As best shown in FIGS. 1 and 2 of the drawings, the anchor davit 1 is adapted to be mounted on a boat, a portion of which is shown at 2, and is adapted to receive an anchor cable 3 connected at one end to an anchor 4. The other cable end may be secured to any suitable mechanism on the boat, such as a selectively operable rotatable drum 5, for hoisting and lowering the anchor.

Anchor 4 is shown as having an elongated shank 6 and an enlarged head 7, as well as a cable-connecting eye 8 on the outer shank end. The anchor construction and cable connection are such that head 7 tends to hang downwardly.

Davit 1 comprises a frame including a base 9 adapted for securement to boat 2, as by screws 10, with the base extending outwardly beyond the edge of the boat to permit clearance by the anchor. A pair of transversely spaced side walls 11 extend upwardly from base 9 and are joined at their forward or outer ends by a shaft 12 suitably secured thereto.

Figure 3:
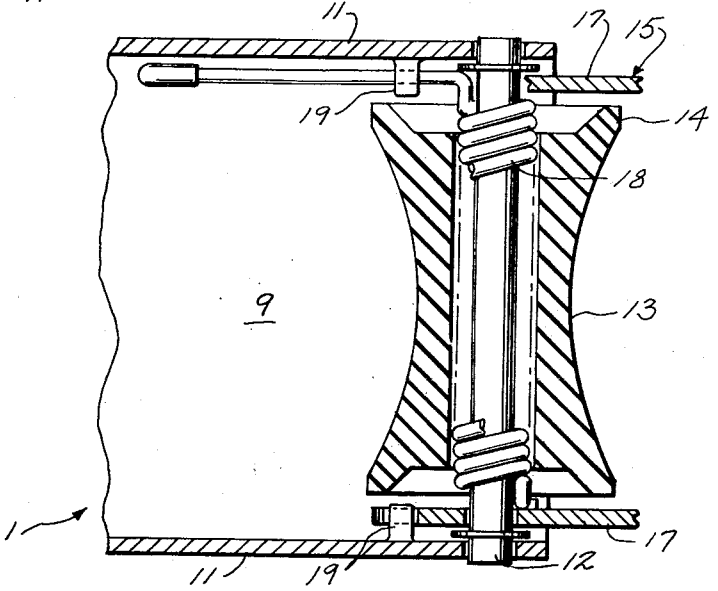
FIG. 3 is a section taken on line 3—3 of FIG. 1.

An anchor support member having a concave surface 13 is disposed about at least a portion of axis 12 and, in the embodiment shown, comprises a roller 14. In addition, a U-shaped retainer strap 15 having a curved bight 16 and end legs 17 is disposed with legs 17 mounted on shaft 12 between side walls 11 and the ends of roller 14. Referring to FIG. 3, strap 15 is continually biased in an outward and downward direction, as by a coil spring 18 mounted concentrically on shaft 12 within the roller hub. Means are also provided to limit the spring-biased pivotal movement of strap 15. For this purpose, inwardly extending lugs 19 are formed in side walls 11 and are engaged by the inner end portions of strap legs 17 so that strap 15 normally assumes a lowered position at a slight angle above the horizontal.

For purposes of raising anchor 4 into davit 1, a control arm 20 is provided, the inner end of which is mounted to a transverse rear shaft 21 defining an axis and extending between side walls 11 and spaced inwardly of the axis of shaft 12. Arm 20 is also biased outwardly, as by a spring 22 mounted concentrically on shaft 21. Referring to FIG. 1, control arm 20 is limited in its biased pivotal movement, as by a rod 23 which extends between side walls 11 between shafts 12 and 21 and which is normally engaged by the arm.

In its lowermost forward normal position, control arm 20 extends upwardly and forwardly from shaft 21 and terminates outwardly of support roller 14 and above the space 24 enclosed by strap 15. The outer terminal portion of arm 20 is bifurcated, providing two transversely spaced projections 25 having a shaft 26 extending therebetween. Shaft 26 carries a concave-surfaced guide roller 27 thereon, as well as a generally U-shaped bracket 28 having an outer wall 29 joining legs 30 which extend between projections 25 and the ends of roller 27 and which are pivotally mounted to shaft 26. When davit 1 is free of cable 3, bracket 28 hangs downwardly on shaft 26.

As best shown in FIG. 1, anchor cable 3 is threaded through bracket 28 and inwardly over roller 27. This causes bracket 28 to freely and pivotally rise about the shaft axis so that wall 29 rides on the cable. The bracket serves as a retainer to keep the cable within the confines of roller 27. Cable 3 then extends inwardly and under a roller 31 at the rear or inner end of davit 1, and hence to drum 5, which is shown as generally on the same level as the davit. In the event that drum 5 is positioned below the boat deck, the cable could be trained downwardly over roller 31 instead.

When anchor 4 is to be raised out of the water, drum 5 is rotated to pull on cable 3. During the initial raising, as shown in FIG. 1, control arm 20 remains in its normal biased outward position, and cable 3 extends vertically from the anchor and over roller 27 and hence inwardly. Cable 3 remains spaced from the surface 13 of roller 14.

The upper end of anchor 4, such as eye 8, eventually passes through strap 15 and engages the outer end portion of arm 20. Continued pulling on cable 3 causes anchor 4 to force arm 20 to pivot inwardly against its spring biasing force and anchor shank 6 ultimately engages roller 14, which acts as a rotary bearing surface for the shank. The intermediate raised position is shown in FIG. 4, wherein the anchor shank has engaged the strap.

Figure 5:
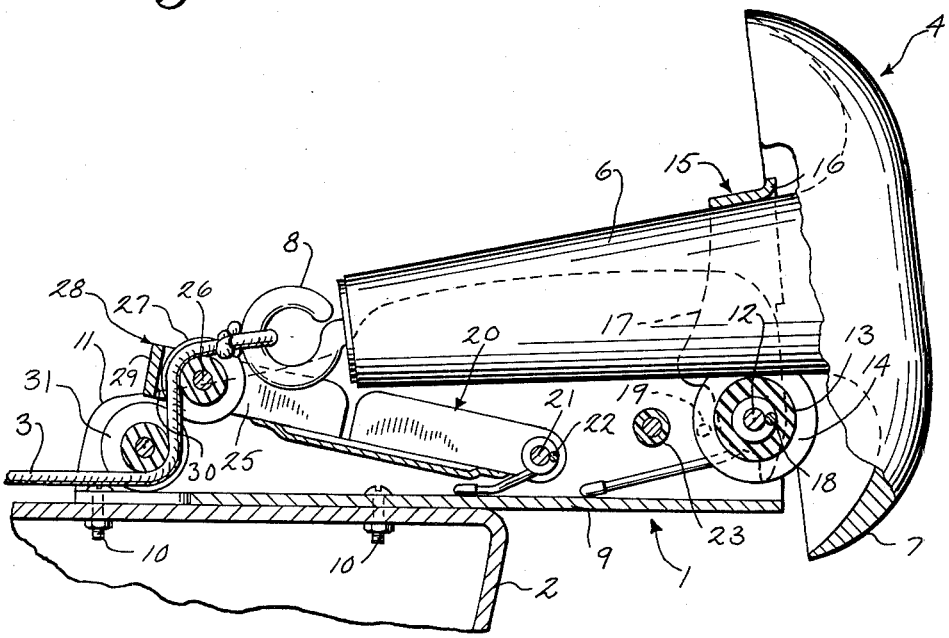
FIG. 5 is a view showing the anchor in stowed position.

Referring to FIG. 5, strap 15 ultimately is engaged by anchor head 7 and is pivoted inwardly or rearwardly against its spring biasing force until control arm 20 engages inner roller 31.

Figure 4:
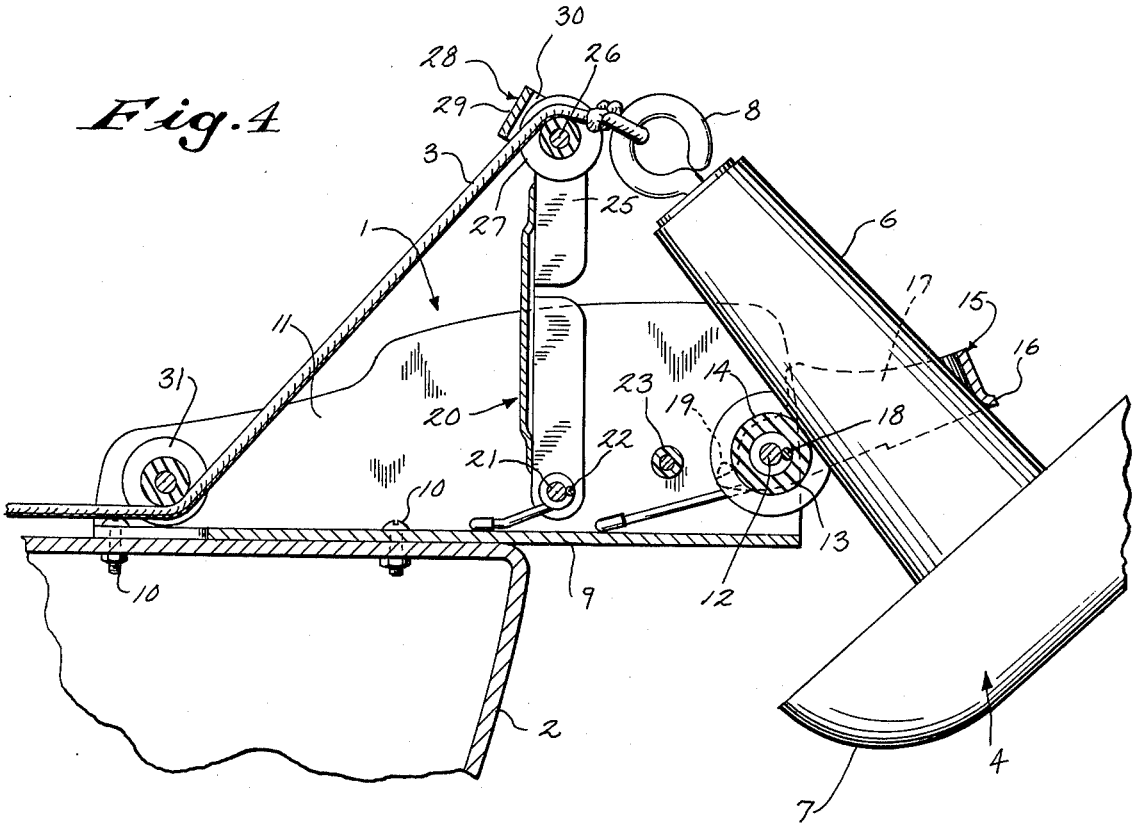
FIG. 4 is a view somewhat similar to FIG. 1 and showing the anchor partially rotated into stowed position.

A comparison of FIGS. 4 and 5 shows that roller 14 functions solely as a pivotal bearing for anchor shank 6. Since the anchor is pulled up through strap 15 and is substantially above the latter before angular movement begins, the tilting anchor path is on a curve of substantially larger radius than with the prior construction heretofore discussed. Binding or catching of the anchor in the davit is thereby substantially eliminated and the pulling force is reduced despite the biasing action of the springs.

Strap 15 functions as a retainer for anchor 4 after it is raised, and assists in forceably returning the anchor from stowed to vertical position for dropping into the water, as will be described.

The spring biasing of strap 15 prevents it from bouncing or raising prematurely while the anchor is being raised, as when the boat is subjected to strong vertical forces upon hitting a wave.

The spring biasing of both strap 15 and arm 20 also assist in keeping the raised anchor from rattling in the davit, due to the constant tension applied thereby.

When the anchor is to be lowered, cable drum 5 is rotated to gradually permit outward unwinding of cable 3. As this occurs, springs 18 and 22 will function in unison to pivot strap 15 and control arm 20 outwardly, thus pushably forcing the anchor to reverse its previously described motion until it drops free of the davit. A positive actuation for anchor release is thus provided.

Various modes of carrying out the invention are contemplated as being within the scope of the following claims particularly pointing out and distinctly claiming the subject matter which is regarded as the invention.

I claim:

1. An anchor davit for mounting to a boat, said davit comprising:

a. a frame adapted to extend beyond the edge of a boat, b. an anchor support member comprising a bearing for said anchor and with said bearing being disposed on the outer end portion of said frame, said bearing being disposed to be normally spaced from the anchor but selectively engageable thereby and always spaced from the anchor cable, c. a control arm having an inner end portion pivotally mounted to said frame and with said arm normally extending upwardly and outwardly to an end portion disposed above and outwardly of said bearing, d. a guide mounted on the outer end portion of said arm for receipt of an anchor cable thereover, e. and means biasing said arm outwardly, f. said biasing means being overcome upon engagement of said control arm by the end of the anchor during the stowing operation to thereby pivot said control arm rearwardly until the anchor engages and pivots about said bearing into a generally horizontal stowed position g. said biasing means maintaining the said anchor cable under tension when the anchor is stowed, and functioning to thrust said control arm and anchor outwardly upon release of the said cable.

2. In the anchor davit of claim 1: means pivotable on said frame and normally disposed beneath said guide for retaining said anchor in stowed position.

3. In the anchor davit of claim 2: means biasing said retaining means outwardly, said last named biasing means acting in unison with said first-named biasing means to thrust said control arm and anchor outwardly upon release of the said cable.

4. The anchor davit of claim 3 in which:

a. said bearing comprises a concave surfaced roller, b. and said retaining means comprises a generally U-shaped strap forming an enclosed space through which a vertically hanging anchor cable is adapted to extend in outwardly spaced relationship to said concave surfaced roller.

5. In the anchor davit of claim 1: a generally U-shaped bracket pivotally mounted on the outer end portion of said control arm and with said bracket having a portion spaced from said guide through which the said anchor cable is adapted to pass and retaining the anchor cable within the confines of said guide.

6. An anchor davit for mounting to a boat, said davit comprising:

a. a frame, b. an anchor support member disposed on the outer end portion of said frame, c. a control arm having an inner end portion pivotally mounted to said frame on a first axis and with said arm normally extending upwardly and outwardly to an end portion disposed above and outwardly of said support member, said arm being pivotable rearwardly by engagement by the anchor until the latter is in a stowed position and engaging said support member, d. a guide mounted on the outer end portion of said arm for receipt of an anchor cable thereover, e. means pivotable on said frame on a second axis spaced from said first axis and normally disposed beneath said guide for retaining said anchor in stowed position, f. and means for biasing said control arm and said retaining means outwardly to cause both said control arm and retaining means to together thrust said anchor outwardly upon release of the anchor cable.

7. An anchor davit for mounting to a boat, said davit comprising:

a. a frame adapted to extend beyond the edge of a boat, b. an anchor support member disposed on the outer end portion of said frame, c. a control arm having an inner end portion pivotally mounted to said frame and with said arm normally extending upwardly and outwardly to an end portion disposed above and outwardly of said support member, d. a guide mounted on the outer end portion of said arm for receipt of an anchor cable thereover, e. means biasing said arm outwardly, f. said biasing means being overcome upon engagement by the end of the anchor during the stowing operation to thereby pivot said control arm rearwardly until the anchor is in a stowed position and engaging said support member, g. said biasing means maintaining the said anchor cable under tension when the anchor is stowed, and functioning to thrust said control arm and anchor outwardly upon release of the said cable, h. means pivotable on said frame and normally disposed beneath said guide for retaining said anchor in stowed position, i. and means biasing said retaining means outwardly, said last-named biasing means acting in unison with said first-named biasing means to thrust said control arm and anchor outwardly upon release of the said cable.

8. The anchor davit of claim 7 in which:

a. said anchor support member comprises a concave surfaced roller, b. and said retaining means comprises a generally U-shaped strap forming an enclosed space through which a vertically hanging anchor cable is adapted to extend in outwardly spaced relationship to said concave surfaced roller.

* * * * *